United States Patent [19]

Frei

[11] 4,168,735

[45] Sep. 25, 1979

[54] VENETIAN BLIND CONSTRUCTION

[75] Inventor: Paul Frei, Elgg, Switzerland

[73] Assignee: Griesser A.G., Switzerland

[21] Appl. No.: 897,432

[22] Filed: Apr. 18, 1978

[30] Foreign Application Priority Data

Apr. 25, 1977 [CH] Switzerland ..... 5092/77

[51] Int. Cl.[2] ..... E06B 9/26

[52] U.S. Cl. ..... 160/176 R

[58] Field of Search ..... 160/168, 172, 174–176

[56] References Cited

U.S. PATENT DOCUMENTS

| | | | |
|---|---|---|---|
| 2,304,934 | 12/1942 | Lawson | 160/176 |
| 2,579,197 | 12/1951 | Levine | 160/176 |
| 3,605,852 | 9/1971 | Vecchiarelli | 160/176 |

FOREIGN PATENT DOCUMENTS

| | | | |
|---|---|---|---|
| 371336 | 5/1973 | U.S.S.R. | 160/176 |
| 514086 | 6/1976 | U.S.S.R. | 160/176 |

*Primary Examiner*—Peter M. Caun

*Attorney, Agent, or Firm*—McGlew and Tuttle

[57] ABSTRACT

A venetian blind construction for use in a building having a recess adjacent a window, comprises, a drive gear for driving the blinds which has a hub portion with a receiving socket for a drive shaft which is contained in a separate venetian blind top box or housing. The drive shaft is supported on spaced apart bearing sleeves contained in the venetian blind housing, and the shaft may be slid axially in the support sleeve bearings after it is first supported on fixed brackets arranged alongside the drive gear so as to cause the shaft to engage in the socket recess to be driven by the drive gear. The shaft is of polygonal section, and it engages in a sleeve of a similar polygonal bore, and the sleeve is rotatably supported in the venetian blind top box housing. Individual slats of the blind are supported on a pull chain which is engaged over a sprocket affixed to a sleeve so that rotation of the drive shaft causes a rotation of the sprocket and movement of the pull chain supporting the blinds.

5 Claims, 5 Drawing Figures

VENETIAN BLIND CONSTRUCTION

FIELD AND BACKGROUND OF THE INVENTION

This invention relates to window covers in general and, in particular, to a new and useful venetian blind having slats which are interconnected by carrying members which are adjustable by means of a pivoting mechanism and include a windup shaft drivable by actuating means and raisable and lowerable by a pulling member engaging the lowermost slat.

DESCRIPTION OF THE PRIOR ART

In venetian blinds of this kind, the pulling member is usually a chain whose upper sprocket wheel on the windup shaft projects outwardly by a considerable distance beyond the plane of the pulling member on the driving side where it is coupled to the drive mechanism. If it is brought to the site of installation with the windup shaft assembled permanently in the bearing housings of the top box of the blind, the installation of the blind is made more difficult.

SUMMARY OF THE INVENTION

In accordance with the present invention, a venetian blind is provided which is particularly easy to install. For this purpose, the venetian blind, according to the invention, includes a windup shaft which is supported in bearing housings of the top box and guided so as to be axially movable in bearing sleeves which rotate with it but which are mounted in the bearing housings so as to be axially fixed. The bearing sleeve ends are flush with the associated bearing housing and each end supports a drive gear which is coupled to the pulling member. The length of the drive shaft does not exceed the distance between the outer faces of the bearing sleeves or the top box.

Due to the shiftability of the windup shaft, it can be brought into and out of engagement with the drive mechanism disposed on the drive side, so that the installation can proceed as follows: The drive mechanism is first attached to brackets mounted to receive the blind; the windup shaft is then pushed completely into the bearing sleeves on the unit formed by the suspension box with inserted windup shaft and a pair of slats mounted thereto, and this assembly is mounted to the brackets in a correct position. The windup shaft can now be shifted axially towards the drive side and brought into engagement with the drive mechanism. In so doing, the bearing sleeves now assure, as before, that the windup shaft is seated securely and is in positive drive connection with the drive gears of the pulling members.

Accordingly, it is an object of the invention to provide an improved venetian blind construction in which a fixed drive mechanism for driving the blinds for adjustment thereof is mounted in a side recess at a fixed location alongside two spaced brackets for holding a venetian blind top box in an arrangement wherein the drive shaft is mounted in the top box in rotatable sleeves which are engaged to a sprocket wheel for the pull chain for the blinds and it may be connected to the drive gear by shifting the shaft axially in its support sleeves into engagement with the gear after the top box is positioned in the support brackets and without disengaging the shaft from the support sleeves.

A further object of the invention is to provide an improved venetian blind construction wherein the drive gear for operating the venetian blinds is mounted at a fixed location in a side recess and the top box for the venetian blinds is mounted above the window alongside the drive gear in a position such that the drive shaft may be slid axially into engagement with the drive gear after installation in the recess and, wherein, the venetian blinds are supported by one or more carrying members and have end parts which are engageable with a pullup chain which engages over a sprocket which is rotatable by the drive gear and drive shaft.

Another object of the invention is to provide a venetian blind construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
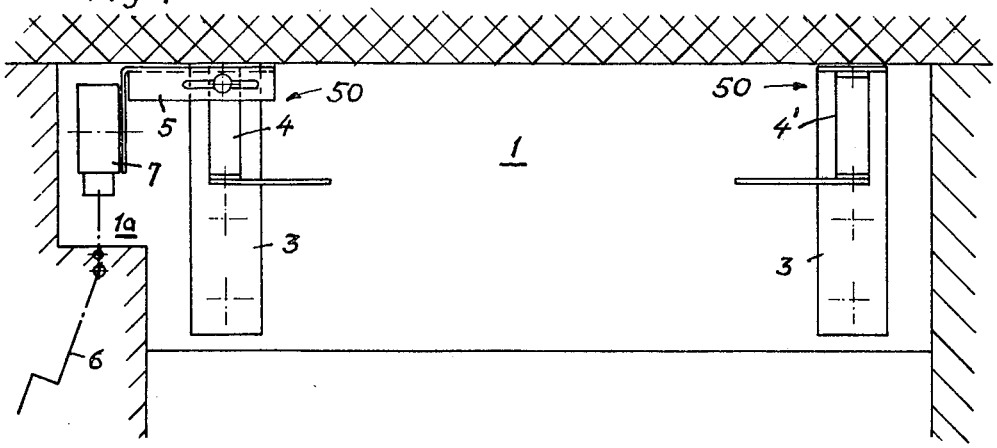
FIG. 1 is a partial side elevational and sectional view of a window installation for a venetian blind installation constructed in accordance with the invention.

Referring to the drawings in particular, the invention embodied therein, comprises, a venetian blind installation which is to be made in a recess 1 located above a window opening 2 and which has a lateral extension 1a in which contains the drive mechanism, generally designated 7. Drive mechanism 7 is mounted in a fixed location in the recess above the window opening and to one side of the mounting means, generally designated 50, for mounting a top window box or venetian blind housing, generally designated 10, so that it is aligned alongside the drive mechanism 7, but spaced therefrom.

In accordance with the invention, the drive shaft 18 is supported in sleeves 12 by a square connection or drive connection for combined rotation together, but in a manner permitting axial shifting movement of the shaft 18. The installation permits the shaft 18 to be carried well within the sleeves 12 and within the top box housing 10 during installation, in which it is inserted between brackets 4 and 4' forming the support for the housing alongside the drive mechanism 7. After installation, the shaft 18 may be slid in the associated supporting sleeves 12 and 12' so that an end projects from the sleeve 12 and into engagement in a socket **7*a* of a drive gear 77. In this manner, the drive mechanism 7 and the venetian blind operating mechanism contained in the top box 10** may be separately installed and easily interconnected after installation.

Figure 4:
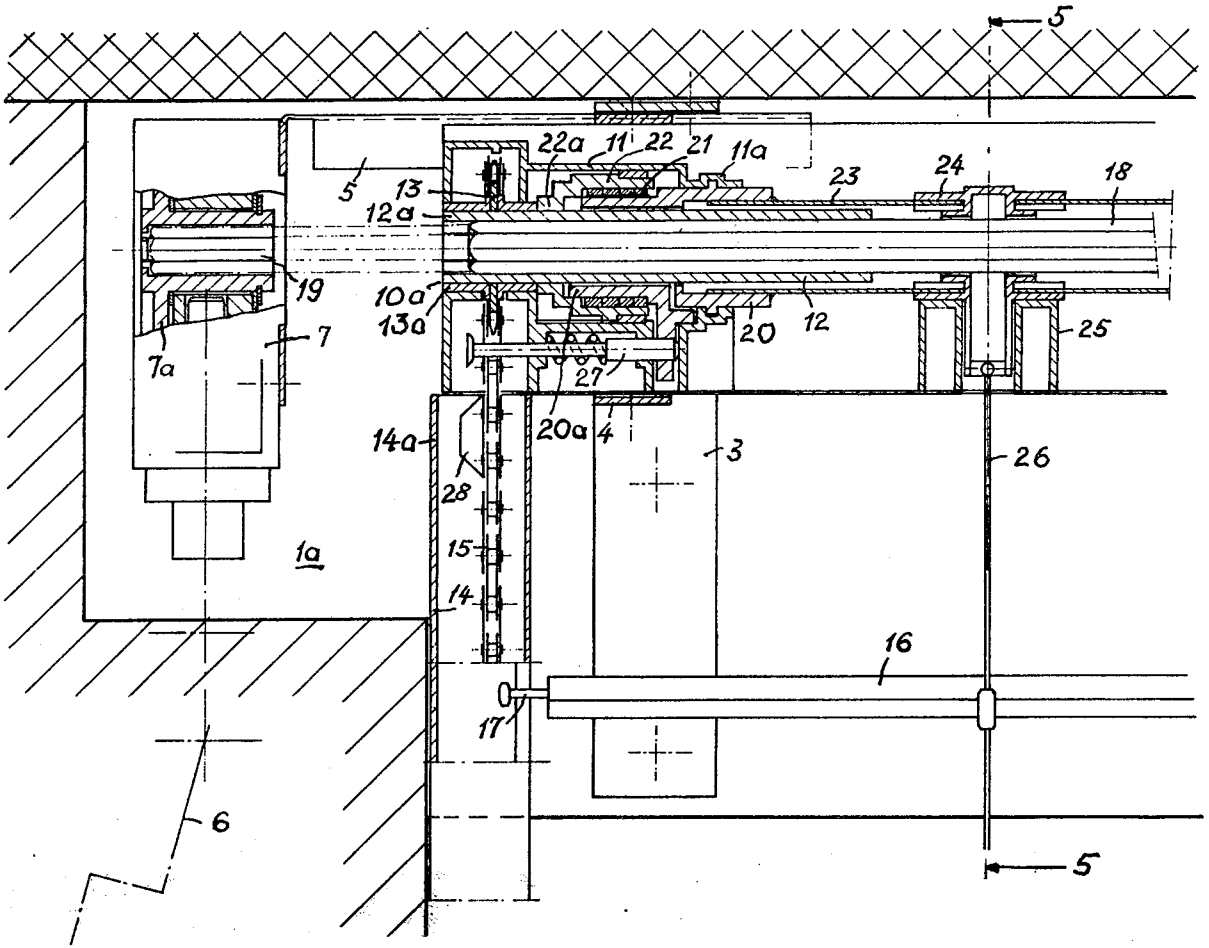
FIG. 4 is a view, similar to FIG. 2, on an enlarged scale showing the details of construction of the installation.
Figure 5:
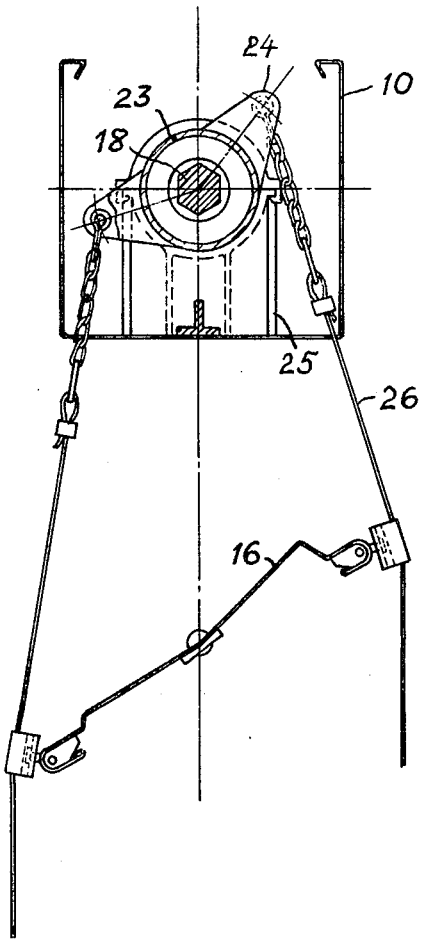
FIG. 5 is a section taken on the line 5—5 of FIG. 4.

As seen in the drawings, 1 indicates the blind installation recess with a lateral expansion 1*a* over the window opening 2. Two angle brackets 3 are mounted to the ceiling and rear wall of recess 1, with the bracket 4 being fixed to each bracket. A support section 5 which projects laterally into the recess expansion 1*a* and supports the drive mechanism 7, such as the one operable by means of a hand crank 6 as shown in FIG. 4, is fastened to the angle bracket 3 disposed on the drive side (on the left in the drawing).

The venetian blind box 10, brought to the building site as a unit, is installed in the thus prepared installation recess 1 alongside the drive unit 7 in recess 1*a*. As may be seen in FIG. 2, this unit comprises a top box 10 which is mounted to the brackets 4. The length of the top box 10 roughly corresponds to the width of the installation recess 1, with a space remaining between the box end on the drive side and the drive mechanism 5. A bearing housing 11 is mounted in each end portion of box 10, in each of which a bearing sleeve 12 is mounted flush with the respective top box or bearing housing end 10*a* or 10*b*. Fixed to the axially outer end portion 12*a* of each bearing sleeve 12 is a sprocket wheel 13 which is engaged by a pull chain 15 guided downwards in lateral compartments 14 defined in side members 14*a* and over a return sprocket wheel (not shown). The lowermost slat of a plurality of blind slats 16 is fixed to the pull chains 15 in the usual manner, with all of the slats being guided by means of guide pins 17 in a longitudinal slot of the lateral compartment 14.

A drive shaft 18 of corresponding polygonal section, the length of which equals the length of the top box 10 is disposed in the two bearing sleeves 12 of the polygonal section which are rotatably mounted in the bearing housings 11 by means of the hub sleeves 13*a* attached to the sprocket wheels 13.

Figure 2:
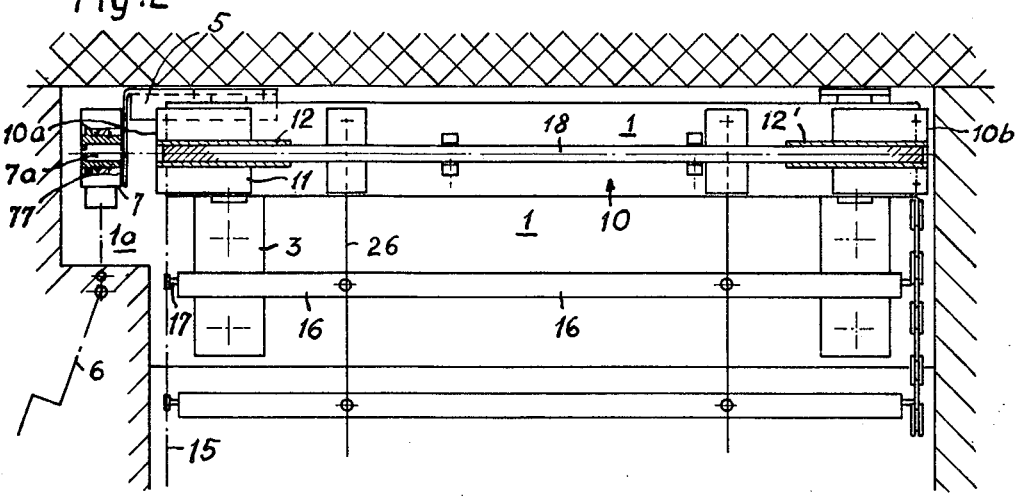
FIG. 2 is a view, similar to FIG. 1, with the venetian blind top box and slat structure supported in the installation.
Figure 3:
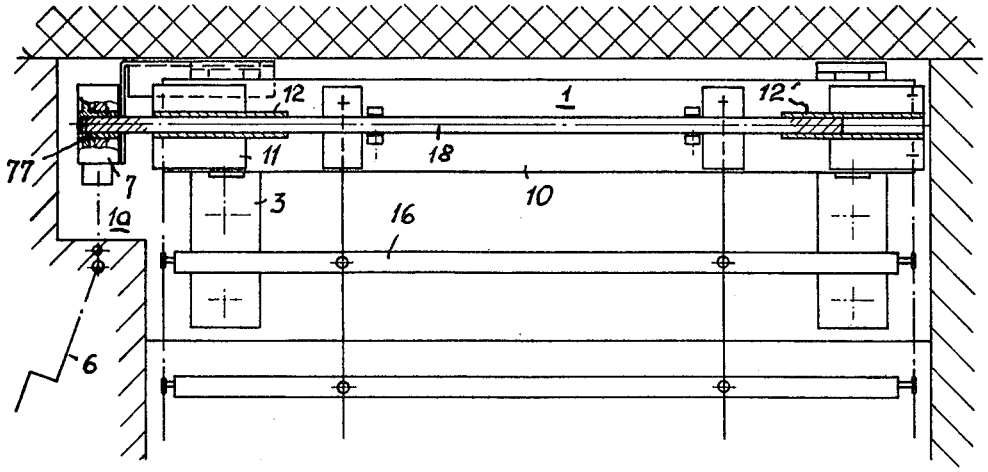
FIG. 3 is a view, similar to FIG. 2, with the drive shaft interengaged with the driving gear.

As may be seen in FIG. 2, the ends of the drive shaft 18 are located completely inside the two bearing housings 11, while the blind unit is being installed, which means that this shaft 18 does not project as usual beyond the top box 10 on the drive side either so that the latter, and with it the entire blind unit, can be mounted to the brackets 4 frontally and in a correct position. The arrangement is such that the drive shaft 18, lying in the top box 10, is in alignment with the seating opening 19 of the driven gear 7*a*. Accordingly, when the installation of the blind unit is completed, the drive shaft 18, lying in the bearing sleeves 12 so as to be axially movable, can be brought into engagement with this gear 7*a* to the left in FIG. 2 and fixed, as seen in FIG. 3. As may be seen, the length of the bearing sleeves 12 projecting inwardly beyond the associated bearing housings 11 is designed so that also the end portion of the shaft 18, on the righthand side thereof, remains seated perfectly in the corresponding bearing sleeve 12 despite its shifting.

The shiftability of the drive shaft 18 in the relatively long bearing sleeves 12 from an assembly position, as seen in FIG. 2, within the length of the top box into its operating position, seen in FIG. 3, quite considerably simplifies the installation without impairing the prefect seating of this shaft.

As seen in FIG. 4, the bearing sleeve 12 on the drive side also serves as a carrier for the adjusting mechanism of the slats 16. This adjusting mechanism has a drive bushing 20 which is mounted in an axially inner end portion 11*a* of the bearing housing 11 and it has an axially outer segment portion 20*a* which supports a double-acting helical adjusting spring 21 whose contact ends (not shown) interact with a brake cylinder 22 mounted securely against rotation to the bearing sleeve 12 by means of an appropriate polygonal hub 22*a*.

An adjusting tube is fastened in the bearing part of drive bushing 20 enclosing the bearing sleeve 12 with a relatively large clearance and it is provided with axially spaced pivoting rockers 24 mounted to supports 25 of the top box 10. Carrying members 26, which may for example comprise strings, tapes, ropes, etc., engage the pivoting rockers. The members 26 which can be pulled up in the usual manner are fastened to slats 16 by flexible connections at fixed intervals along its length. The adjustment tube 23 supports the rockers 24 only at the respective points of engagement of the carrying members 26, whereas, the actual adjusting mechanism coordinated with all rockers is accommodated in the bearing housing 11 on the drive side. This is a substantial advantage over the known solutions in which a separate, complete adjusting mechanism each is provided on each point of engagement of the carrying members, i.e., usually on two or more points spread over the width of the blind. This is not only less expensive, but also facilitates the installation and the servicing of this mechanism.

As may be seen from FIG. 4, a spring-loaded disengagement pin 27 which can be caused by means of a disengagement cam 28, attached to the pull chain 15, to disengage from the segment 20*a* of the adjusting mechanism, and thus release it, is mounted in the bearing housing 11 on the drive side. The hole provided in segment 20*a* permits the locking of the adjusting mechanism. The engagement of the pin 27 is effected with the slats 16 in an oblique position between the open and closed positions. This makes it possible in a simple manner to bring the slats of, for example, all of the blinds of a house front into the identical oblique position.

While a specific embodiment of the invention has been shown and described in detail to illustrate the application of the principles of the invention, it will be understood that the invention may be embodied otherwise without departing from such principles.

What is claimed is:

1. A venetian blind construction, for use in a building having a recess adjacent a window to be covered by a blind, comprising, a rotatable drive gear for driving the blinds, having a hub portion with a shaft receiving socket, mounting means supporting said drive gear for rotation in a fixed location in the recess, a venetian blind housing, first and second axially spaced and axially elongated, rotatable bearing sleeves rotatably mounted at fixed locations in said housing, a drive shaft about as long as said housing engaged in said bearing sleeves and being rotatable therewith but being axially displaceable relative to said bearing sleeves, housing support means mounted in a fixed location spaced away from one side of said drive gear, said blind housing being engageable in said support means in alignment with said drive gear, a drive sprocket on said first sleeve affixed thereto for rotation therewith, a pull chain engaged over said drive sprocket, a slat-carrying member connected to said blind housing, a plurality of slats connected to said carrying member at spaced locations along its length and having at least one end connected to said pull chain for adjustable movement in response to movement of said pull chain, said drive shaft being containable within said housing but being axially shiftable in said first and second bearing sleeves to cause one end to extend out of said housing into engagement with said shaft receiving socket with said drive shaft still supported by both said first and second bearing sleeves.

2. A venetian blind construction, as claimed in claim 1, including a rocker connected to said first bearing sleeve and being pivotable thereby, said carrying member being connected to said rocker.

3. A venetian blind construction, as claimed in claim 1, including an adjusting tube connected to said first bearing sleeve supported on said housing, a rocker member connected to said adjusting tube, a bushing connected to said first bearing sleeve, said adjusting tube including a segmental portion, an adjusting spring between said bushing and said segmental portion comprising a double-acting spring connected to said bushing.

4. A venetian blind construction, as claimed in claim 3, including a pin displaceably mounted on said housing adjacent said first bearing sleeve, cam means carried by said pull chain engageable with said pin for moving it from an engaged position to a disengaged position, and a segmental portion connected to said rocker having an opening therethrough into which a pin engages to lock said adjusting tube to said segmental portion for rotation of said segmental portion with said adjusting tube with said bearing sleeve.

5. A venetian blind construction, as claimed in claim 4, wherein said slats are held at an oblique position by said carrying member when said pin is in a position at which it may be disengaged from said segmental portion by said cam.

* * * * *